US012011074B2

(12) United States Patent
Labirio et al.

(10) Patent No.: US 12,011,074 B2
(45) Date of Patent: Jun. 18, 2024

(54) AIR HEATING DEVICE FOR A HAIRDRYER, BLOWING DEVICE FOR A HAIRDRYER, AND HAIRDRYER COMPRISING SAID DEVICES

(71) Applicant: GAMMA S.P.A., Bobbio (IT)

(72) Inventors: Marco Labirio, Bobbio (IT); Pierpaolo Laveni, Piacenza (IT); Renzo Re, Ferriere (IT); Daniele Ferri, Bobbio (IT)

(73) Assignee: GAMMA S.P.A., Bobbio (IT)

( * ) Notice: Subject to any disclaimer, the term of this patent is extended or adjusted under 35 U.S.C. 154(b) by 771 days.

(21) Appl. No.: 17/260,951

(22) PCT Filed: Jul. 8, 2019

(86) PCT No.: PCT/IB2019/055780
§ 371 (c)(1),
(2) Date: Jan. 15, 2021

(87) PCT Pub. No.: WO2020/016696
PCT Pub. Date: Jan. 23, 2020

(65) Prior Publication Data

US 2021/0321737 A1 Oct. 21, 2021

(30) Foreign Application Priority Data

Jul. 18, 2018 (IT) ..... 102018000007305

(51) Int. Cl.
*A45D 20/10* (2006.01)
*A45D 20/12* (2006.01)

(52) U.S. Cl.
CPC ..... *A45D 20/12* (2013.01); *A45D 20/10* (2013.01); *A45D 2200/155* (2013.01)

(58) Field of Classification Search
CPC ..... A45D 20/10; A45D 20/12; A45D 20/38; A45D 2200/155; H05B 2203/014; H05B 2203/022; H05B 3/16
(Continued)

(56) References Cited

U.S. PATENT DOCUMENTS 4,260,875 A * 4/1981 Walter ..... A45D 20/12 34/554
5,875,562 A * 3/1999 Fogarty ..... A45D 20/10 34/97
(Continued)

FOREIGN PATENT DOCUMENTS

DE 2940468 A1 4/1981
DE 19616877 A1 10/1996
EP 3178348 A1 6/2017

OTHER PUBLICATIONS

International Search Report and Written Opinion for application PCT/IB2019/055780 filed Jul. 8, 2019, dated Nov. 14, 2019.

*Primary Examiner* — Sang Y Paik
(74) *Attorney, Agent, or Firm* — Workman Nydegger

(57) ABSTRACT

An air heating device for a hairdryer includes an inner tubular body with an outer surface from which a plurality of angularly spaced, radial baffles extend to define a plurality of angular sectors, a corrugated resistive coil extending around the inner tubular body, a safety device in electrical connection with said corrugated resistive coil, a thermostat in electrical connection with the corrugated resistive coil, and an outer tubular body arranged coaxially with the inner tubular body around the corrugated resistive coil. The safety device and the thermostat are respectively housed in a first and a second angular sector, which are adjacent to each other and separated by a shared radial baffle. The corrugated resistive coil two rectilinear portions positioned at the first and the second angular sector, respectively, At least one
(Continued)

anchoring wave is interposed between the rectilinear portions and overlies said shared radial baffle.

13 Claims, 6 Drawing Sheets

(58) Field of Classification Search
USPC ..... 392/373–380; 219/221–222
See application file for complete search history.

(56) References Cited

U.S. PATENT DOCUMENTS

2004/0091250 A1* 5/2004 Stritzinger ..... H05B 3/16
219/536
2017/0164709 A1* 6/2017 Laveni ..... A45D 20/10

* cited by examiner

Fig.5
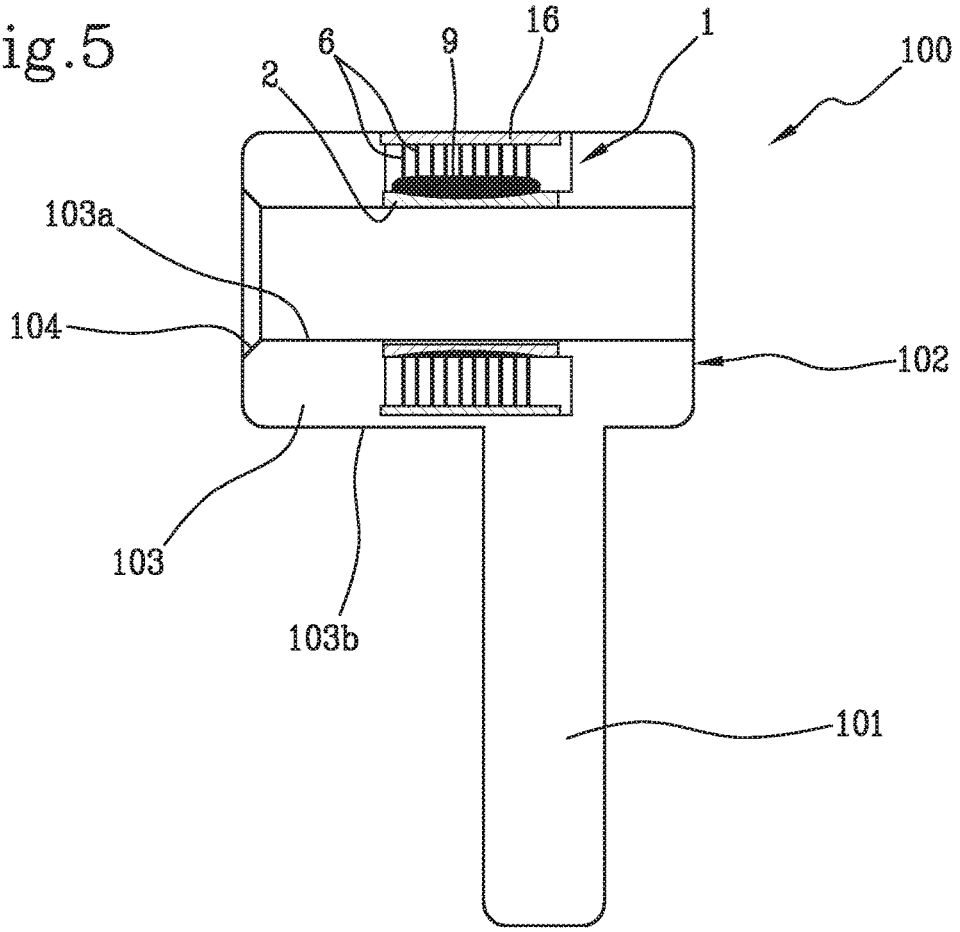
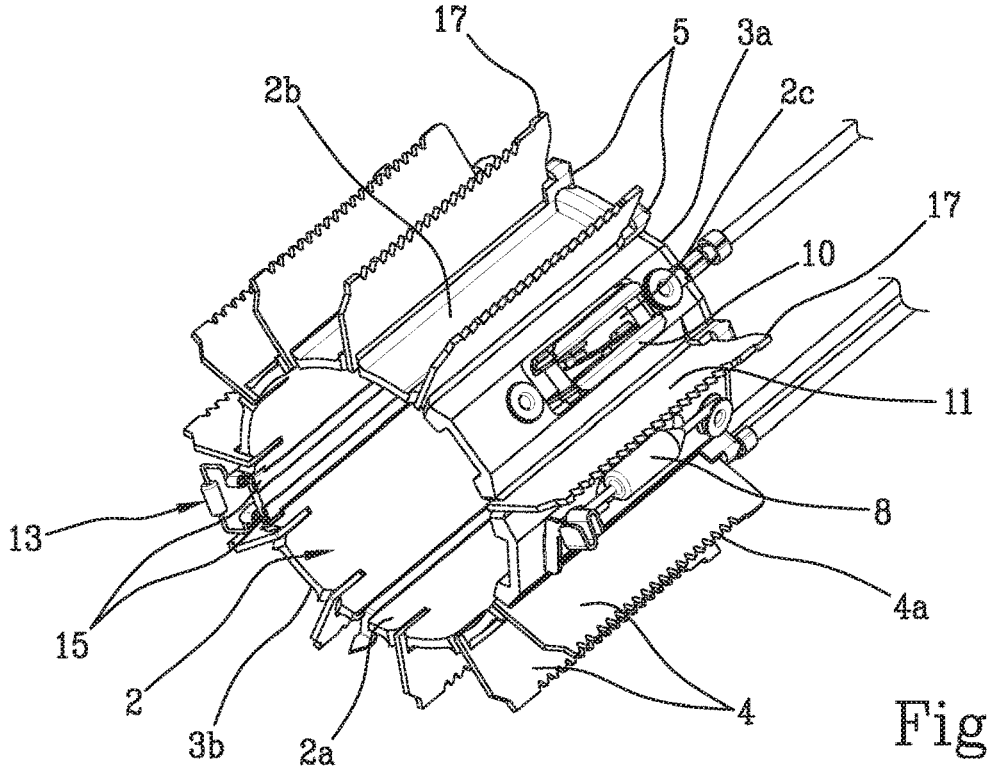
Fig.4

AIR HEATING DEVICE FOR A HAIRDRYER, BLOWING DEVICE FOR A HAIRDRYER, AND HAIRDRYER COMPRISING SAID DEVICES

The present invention relates to an air heating device for a hairdryer, a blowing device for a hairdryer, and a hairdryer comprising said devices.

Therefore, the present invention finds its main application in the field of small household appliances and more precisely in the production and manufacture of the heating components to be inserted inside the blow duct of a hairdryer.

The hairdryer sector, which for several years has been poorly innovated with regard to the final product, has recently had a considerable innovative boost both from the point of view of technology and from the point of view of the design.

In particular, new conformations of blow ducts have been developed, which differ from the classic tapered tubular body and have different and more attractive geometries.

A conformation that is having particular success is the annular one, wherein the blow duct is not "trivially" delimited by a more or less cylindrical tubular duct, but extends annularly inside a chamber suitably delimited by a pair of concentric tubes.

This conformation, in addition to allowing a particular and efficient air ejection, gives the product an attractive and distinctive appearance due to the "through" light passing through the main body of the appliance.

However, a solution of this type brings along considerable problems of space, as the available volume for the housing of all the components useful for heating the air, first of all defined by the heating device, i.e. the electrical resistance, is in fact very limited.

Therefore, the object of the present invention is to provide an air heating device for a hairdryer, a blowing device and a hairdryer comprising said device, which are capable of overcoming the above-mentioned drawbacks of the prior art.

In particular, one object of the present invention is to provide an air heating device for a hairdryer, which is compact and efficient.

In addition, a further object of the present invention is to provide a hairdryer, which is particularly powerful in increasing the air flow rate.

Said objects are achieved by means of an air heating device for a hairdryer having the features of one or more of the successive claims 1 to 10, as well as by means of a blowing device for a hairdryer according to claims 11 and 12 and a hairdryer according to claim 13.

In particular, the objects of the present invention are achieved by means of an air heating device for a hairdryer comprising an inner tubular body extending along a central axis and provided with an outer surface from which a plurality of mutually angularly spaced, radial baffles extend so as to define a plurality of angular sectors.

Preferably, there is provided a corrugated resistive coil extending circumferentially around said inner tubular body, resting on said radial baffles, and defining a plurality of turns arranged in succession along the central axis.

Preferably, there is provided a safety device placed in electrical connection with said coil.

The device preferably comprises a thermostat placed in electrical connection with said coil.

Preferably, there is provided an outer tubular body made of insulating material and arranged coaxially with said inner tubular body around said corrugated resistive coil.

Preferably, the safety device and the thermostat are respectively housed in a first and a second angular sector, which are adjacent to each other and separated by a shared radial baffle.

Preferably, the corrugated resistive coil comprises a plurality of first turns provided with:

- two rectilinear portions positioned at the first and the second angular sector, respectively;
- at least one anchoring wave interposed between said rectilinear portions and overlying said shared radial baffle.

Advantageously, in this way, a space is obtained for housing the safety device and the thermostat without compromising the stability of the coil.

Preferably, moreover, the safety device and the thermostat have a respective axial overall size along said central axis (smaller than that of the inner tubular body).

The plurality of first turns preferably extends at least at said axial overall size.

Preferably, moreover, the corrugated resistive coil comprises one or more second turns located outside of said axial overall size and devoid of said rectilinear portions.

Advantageously, in this way, heat generation is maximized without compromising the volume of the heating device.

The device preferably comprises a thermistor arranged outside the inner tubular body at a third angular sector and oriented transversely to said central axis, to maximize the surface in contact with the air flow.

It should be noted that the inner tubular body extends along the central axis between a first section, in use an air flow inlet, and a second section, in use an air flow outlet.

The thermistor is preferably located in the vicinity of the second section in order to receive a flow of air heated by the corrugated resistive coil.

To allow supply of power to the thermistor and the corrugated wire, there are provided a plurality of electrical connections arranged at said first section of the inner tubular body and at least a pair of conductive tracks anchored to the inner tubular body and extending from said electrical connections up to said thermistor.

According to a further aspect of the invention, complementary but independent with respect to what has been described up to now, the objects of the present invention are achieved by means of a hairdryer comprising a handle and a main body extending transversely to said handle and defining therein a containment compartment.

Preferably, said main body extends along its main axis between a suction mouth and an air outlet defining an annular blowing nozzle.

In particular, the main body extends between a first and a second end portion.

Preferably, the first end portion has the suction mouth, and the second end portion has the air outlet defining an annular blowing nozzle.

Preferably, there is provided a blowing device housed in the containment compartment.

The blowing device preferably comprises an air heating device for a hairdryer, an electric motor and a fan.

Preferably, the air heating device comprises an inner tubular body extending along a central axis and around which a corrugated resistive coil is wound, the latter defining a plurality of turns arranged in succession along the central axis.

Preferably, the electric motor is provided with a stator body housed inside the inner tubular body of the heating device and equipped with a drive shaft rotatable coaxially with said central axis.

Preferably, the fan is fixed to a free end of the drive shaft and provided with a plurality of blades shaped so as to generate a flow of air directed toward the heating device.

Preferably, the blowing device is oriented so that said fan is interposed between said suction mouth and said inner tubular body of the heating device.

Advantageously, in this way, it is possible to obtain a hairdryer with a high coefficient of increase in the air flow rate even in the presence of a casing (or body) of the traditional type, making the device simple and inexpensive to manufacture.

According to a further aspect of the invention, the blowing device comprises a control circuit controlling said electric motor and said heating device, which is housed inside said inner tubular body of the heating device and abutted against the stator body of the electric motor.

These and other features, together with the advantages related thereto, will become more apparent from the following illustrative, therefore non-limiting, description of a preferred, thus non-exclusive, embodiment of an air heating device and a blowing device for a hairdryer, as shown in the accompanying figures, wherein:

FIG. 4 shows a rear perspective view of an air heating device in FIG. 1, with some parts removed to highlight others;

FIG. 5 shows a schematic sectional view of a hairdryer according to a first embodiment of the present invention;

Figure 1:
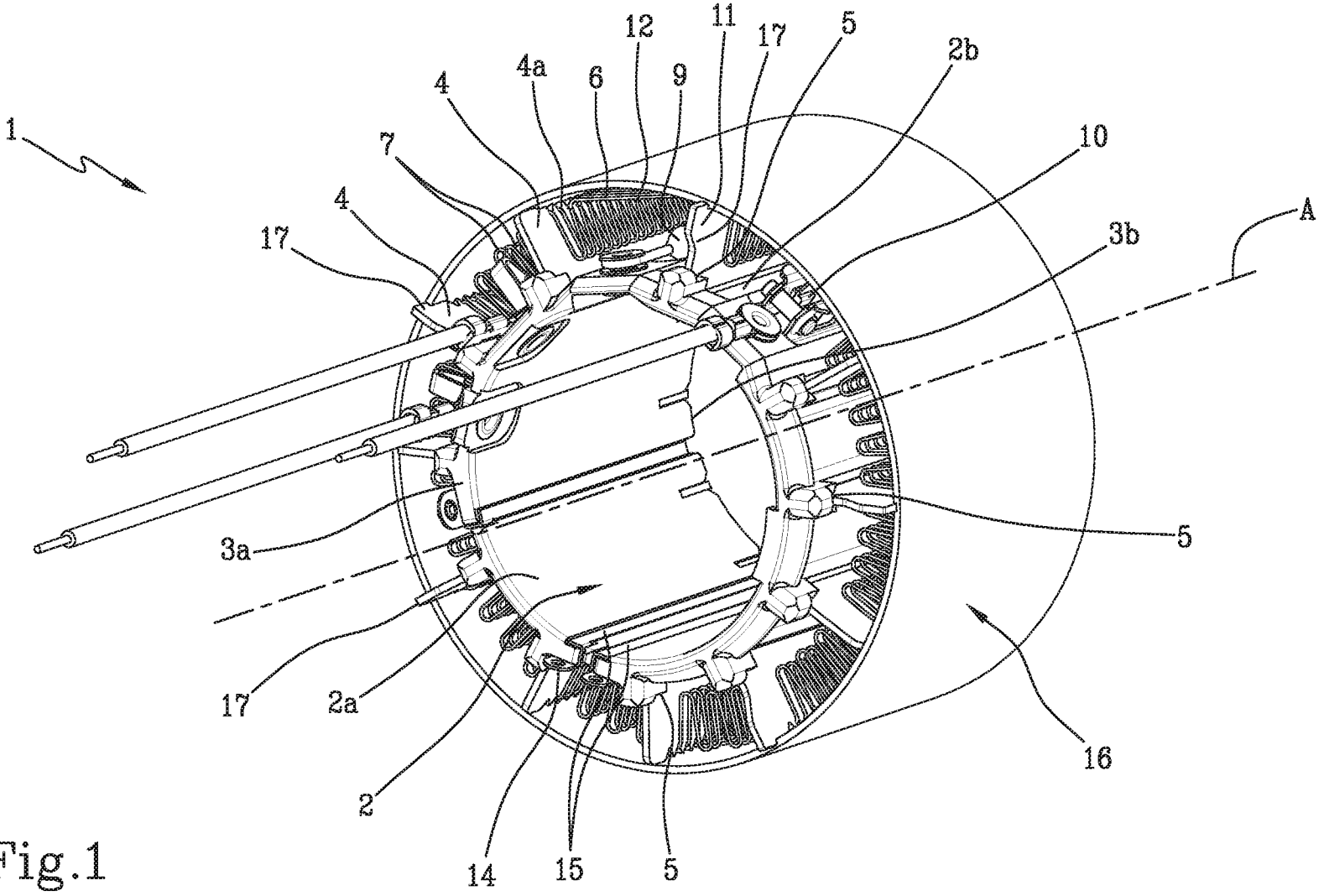
FIG. 1 shows a front perspective view of an air heating device for a hairdryer according to the present invention.
Figure 2:
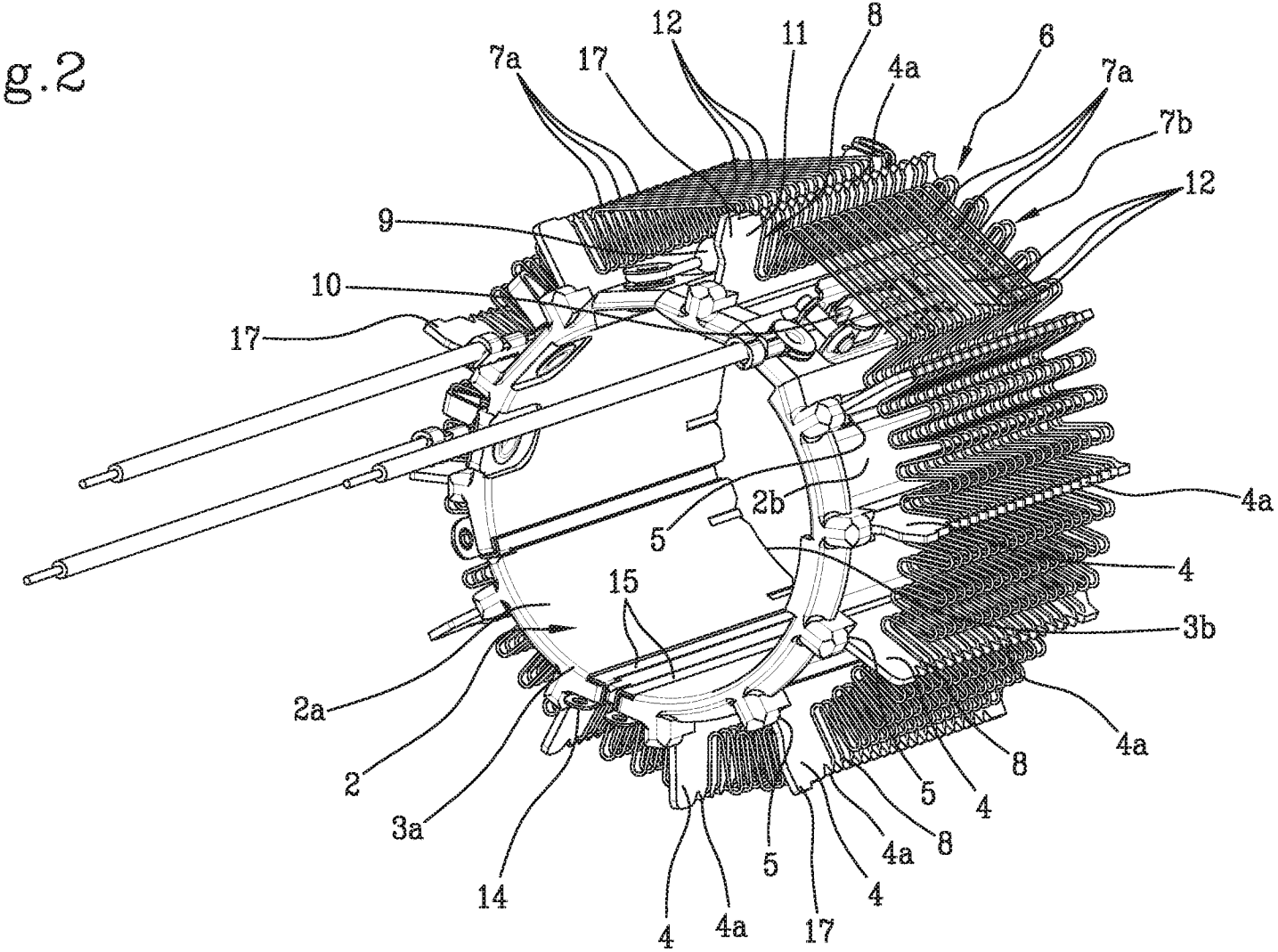
FIG. 2 shows the same perspective view as FIG. 1, with some parts removed to highlight others.
Figure 3:
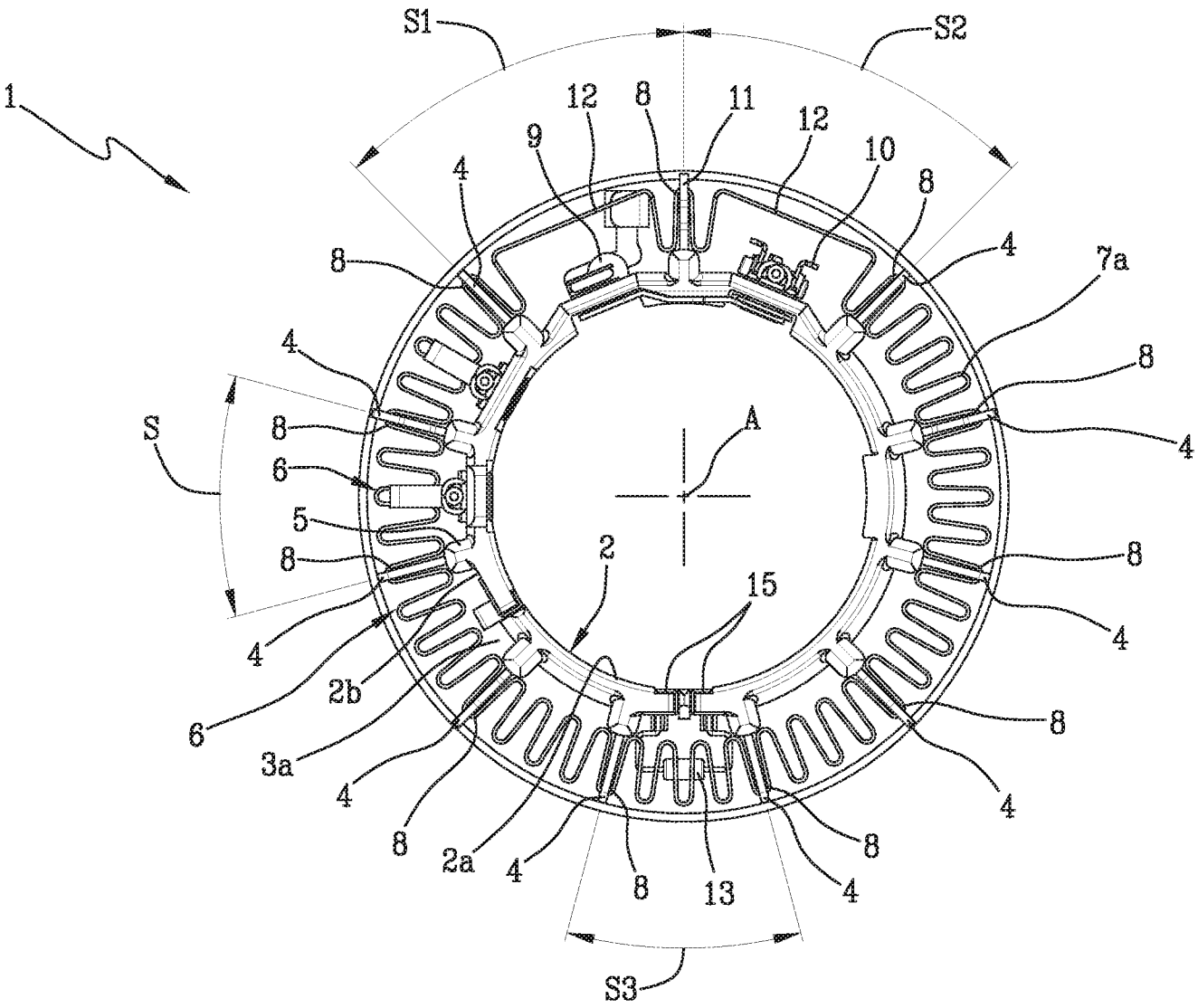
FIG. 3 shows a front view of the heating device in FIG. 1.
Figure 6B:
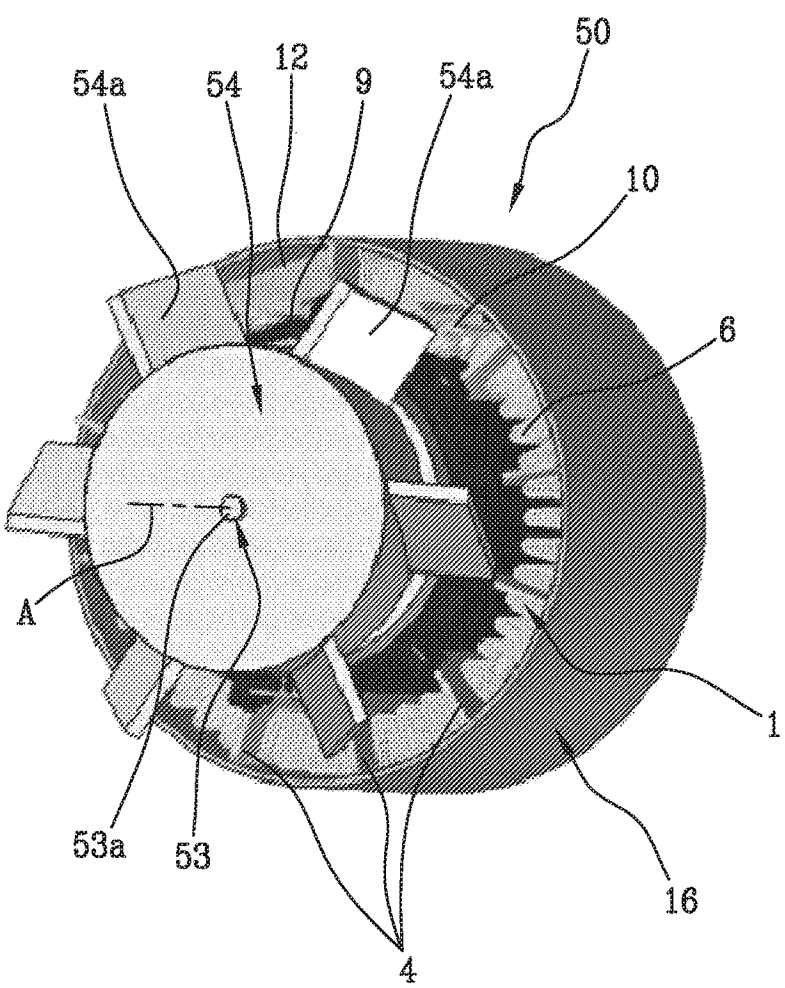
Figure 6A:
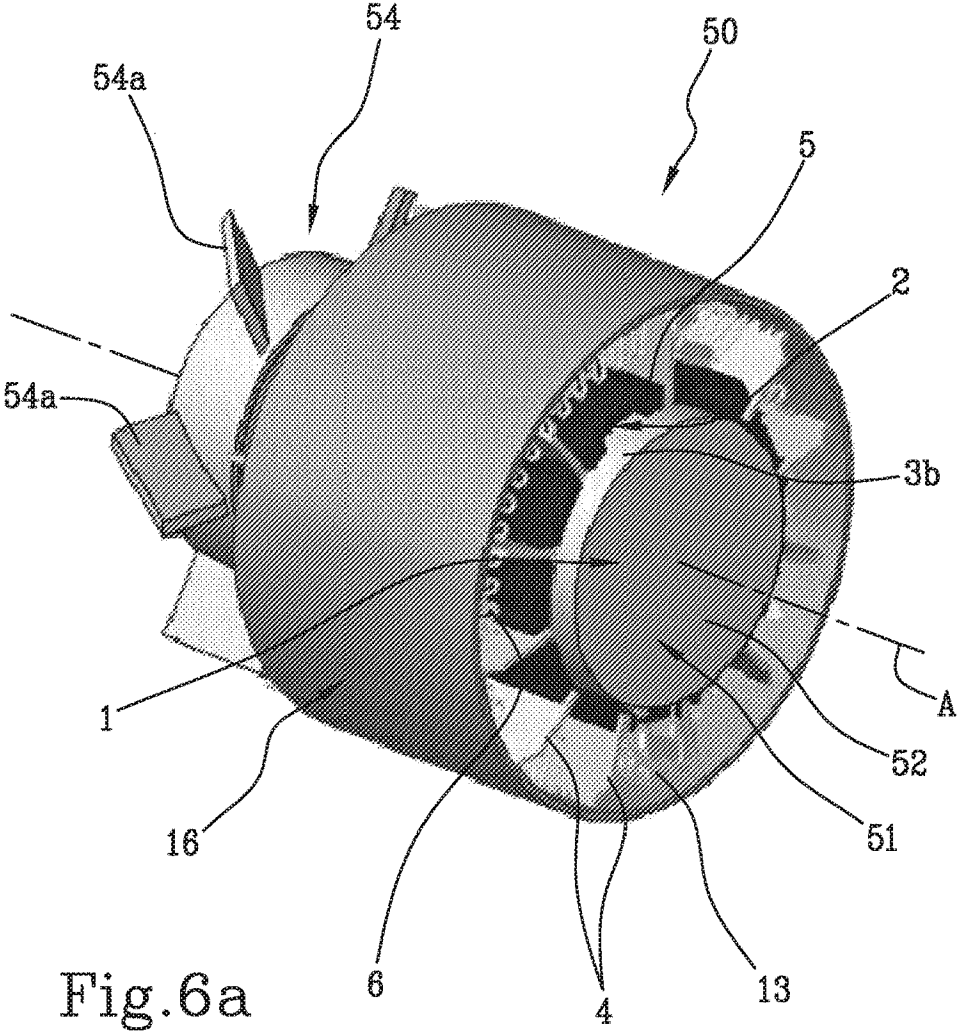
Figures 7A, 7B, 7C:
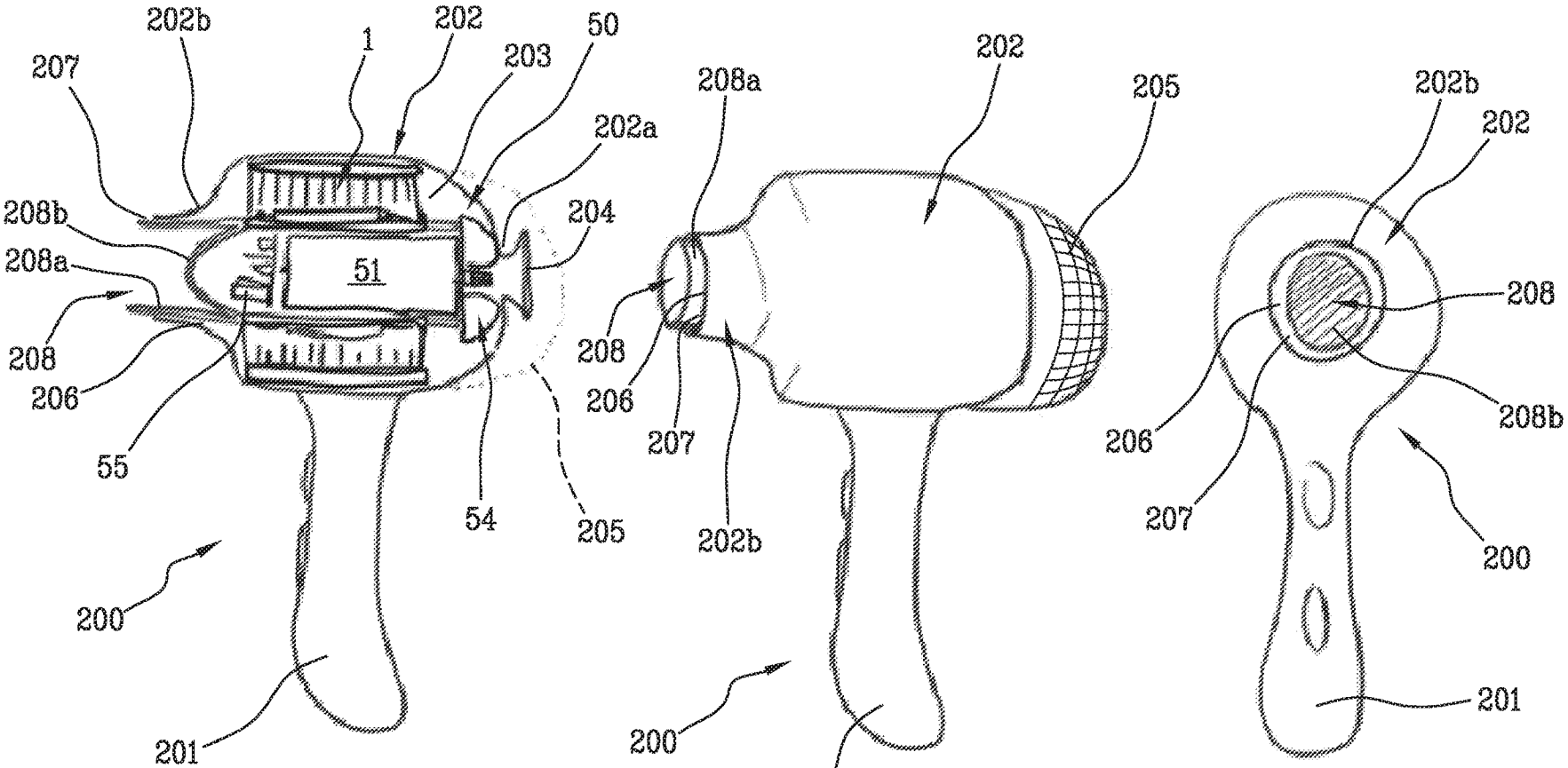

FIGS. 6*a* and 6*b* show front and rear perspective schematic representations, respectively, of a blowing device for a hairdryer according to the present invention;

FIGS. 7*a*-7*c* schematically show a sectional view, a side view and a front view of a hairdryer according to a second embodiment in accordance with the present invention.

With reference to the accompanying figures, the numeral 1 indicates an air heating device for a hairdryer 100, 200 according to the present invention.

The heating device 1 is of the type commonly defined as "resistance" in that it comprises, in addition to a support (better described below), a resistive coil which, when an electric current passes through it, overheats so as to raise the temperature of an air flow hitting it.

In general, therefore, the air heating device 1 comprises a support around which at least one resistive wire is wound, which in use is hit by an air flow generated by ventilation/blowing means, operatively placed upstream, in order to raise its temperature.

With reference to the present invention, the support is defined by an inner tubular body 2 extending along a central axis "A" and provided with an inner surface 2*a* and an outer surface 2*b*, both substantially cylindrical.

The inner tubular body 2 extends longitudinally along the central axis "A" between a first section 3*a* and a second section 3*b*.

In use, that is with the device 1 mounted in the hairdryer 100, 200, the first section 3*a* is an air flow inlet section, whereas the second section 3*b* is an air flow outlet section.

A plurality of mutually angularly spaced, radial baffles 4 extend from the outer surface 2*b* of the inner tubular body 2, so as to define a plurality of angular sectors "S".

The radial baffles 4 extend parallel to the main axis and, starting from the outer surface 2*b* of the inner tubular body 2, away from it along a radial direction (diverging from the central axis "A"), between a radially inner edge, engaged within the inner tubular body 2, and a radially outer edge 4*a*.

The inner tubular body 2 is preferably provided with a plurality of retaining portions 5 coupled to the radial baffles 4.

More precisely, the inner tubular body 2 comprises, at the outer surface 2*b*, a plurality of coupled/couplable housings, each with a respective radial baffle 4 so as to hold it and keep it in an upright position.

It should be noted that, in the preferred embodiment, the inner tubular body 2 is a single body, and the retaining portions 5 are formed directly thereon.

Preferably, the inner tubular body 2 is made of a thermal insulating plastic material, and more preferably the retaining portions 5 are obtained by moulding.

Instead, the radial baffles 4 are preferably made of an electrical insulating and thermal resistant material, for example mica or other antistatic material.

The device 1 further comprises a corrugated resistive coil 6 extending circumferentially around the inner tubular body 2 which, as previously mentioned, has the purpose of heating the air flow hitting it.

The coil 6 extends resting on the radial baffles 4 and defines a plurality of turns 7 arranged in succession along the central axis "A".

It should be noted that, to maximize heat transfer, the resistive wire forming the coil 6 is shaped according to at least one predetermined waveform, which can comprise sinusoidal and/or zig-zag and/or square and/or spiral undulations, and more generally undulations of any form.

In the illustrated embodiment, each turn 7 of the coil extends circumferentially around the inner tubular body 2 according to a wavy pattern defining a succession of peaks and grooves.

Preferably, the radially outer edge 4*a* of each radial baffle 4 has a toothed shape in order to define a succession of housing seats for the turns 7 of the resistive coil 6.

In other words, a groove is formed between two successive teeth which accommodates therein the section of the turn 7 resting on the radial baffle 4, preventing it from sliding axially.

Preferably, the turns 7 are sized so that an anchoring wave 8, defined by at least one peak of the corrugated wire overlying the radially outer edge 4*a*, is arranged at each radial baffle 4.

Advantageously, this structure gives stability to the coil, maximizing its efficiency and, above all, guaranteeing its robustness to impacts.

In order to ensure the safety of the coil 6, both from a thermal and an electrical point of view, the device 1 comprises a safety device 9 and a thermostat 10 placed in electrical connection with said corrugated resistive coil 6.

More precisely, the safety device 9 and the thermostat 10 are arranged electrically upstream of the corrugated resistive coil 6, in order to allow an interruption in the current flow before it passes through the resistive wire.

The safety device 9 is preferably a thermal fuse, more preferably calibrated (with temperatures from 70° C. to 260° C.) to prevent excessive temperatures in abnormal operating conditions.

The thermostat 10, on the other hand, is preferably calibrated (with temperatures from 60° C. to 170° C.) to open the contact, in a reversible manner, when a temperature limit value is exceeded.

According to one of the aspects of the present invention, the safety device 9 and the thermostat 10 are respectively housed in a first "S1" and a second angular sector "S2", which are adjacent to each other and separated by a shared radial baffle 11.

More precisely, the safety device 9 and the thermostat 10 each extend along a preferential direction oriented parallel to the central axis "A". In the preferred embodiment, the inner tubular body 2 has, at said first S1 and/or second angular sector S2, respective slots 2*c* for receiving the safety device 9 and/or the thermostat 10.

This slot allows at least part of the thickness of the safety device 9 or of the thermostat 10 to be embedded in the inner tubular body 2, thus reducing its radial overall size within the respective angular sector.

It should be noted that the first "S1" and the second angular sector "S2" preferably have a greater size than the other angular sectors "S".

In the preferred embodiment, the first "S1" and the second angular sector "S2" have the same angular size, more preferably about 45°.

The other angular sectors "5", instead, have an angular size of about 30°.

In other words, the radial baffles 4 defining the angular sectors "5" are angularly equally spaced from one another, with the exception of the radial baffles 4 defining the first "S1" and the second angular sector "S2", which have a different angular arrangement in order to increase the housing volume for the safety device 9 and the thermostat 10.

According to a further aspect of the invention, in addition, the corrugated resistive coil 6 comprises a plurality of first turns 7*a* provided with:

- two rectilinear portions 12 positioned at the first "S1" and the second angular sector "S2", respectively;
- at least one anchoring wave 8 interposed between said rectilinear portions 12 and overlying said shared radial baffle 11.

Advantageously, in this way, it is possible to create a space sufficient to accommodate the safety device 9 and the thermostat 10 within the first "S1" and the second angular sector "S2", without compromising either the efficiency of the device 1 or its robustness.

Preferably, the anchoring wave 8 comprises two grooves between which a peak straddling the shared radial baffle 11 is interposed, preferably housed between two successive teeth of the radially outer edge of the baffle.

Therefore, the rectilinear portions 12 define, in fact, two prismatic housings (i.e. parallelepipeds) extending along the central axis "A" outside the inner tubular body 2.

It should be noted that the safety device 9 and the thermostat 10 have a respective axial overall size along the central axis "A", preferably smaller than the axial extent of the inner tubular body 2, and the plurality of first turns 7*a* of the corrugated resistive coil 6 extends at said axial overall size. According to a preferred embodiment, the corrugated resistive coil 6 comprises one or more second turns 7*b* located outside of said axial overall size and devoid of said rectilinear portions 12.

Advantageously, in this way, the distribution of the coil is optimized and the generation of heat is maximized.

Preferably, moreover, the device further comprises a thermistor 13 arranged outside the inner tubular body 2 at a third angular sector S3 and oriented transversely to said central axis "A".

Preferably, for the measurement to be accurate and consistent with the user's perception, the thermistor 13 is located near the second section 3*b* of the inner tubular body 2.

In this way, in fact, the thermistor is positioned so as to receive the air flow already heated by the corrugated resistive coil 6, reducing as much as possible the delay between the user's perception and a possible control.

In this regard, it should be noted that the device 1 comprises a plurality of electrical connections 14 arranged at the first section 3*a* of the inner tubular body 2. To allow transmission of the current to the thermistor 13, there is provided at least one pair of conductive tracks 15 anchored to the inner tubular body 2 and extending from said electrical connections 14 up to said thermistor 13.

Preferably, the pair of tracks 15 is anchored to the inner surface 2*a* of the inner tubular body 2.

Preferably, moreover, the device 1 further comprises an outer tubular body 16 made of insulating material and arranged coaxially with said inner tubular body 2 around said corrugated resistive coil 6, in order to protect it.

In the preferred embodiment, the outer tubular body 16 is also made of mica or the like, however of the same material as the radial baffles 4.

Preferably, during positioning, the outer tubular body 16 is fitted onto the inner tubular body 2.

In this regard, in order to facilitate the achievement of an assembled position, the radially outer edge of at least one part of the radial baffles 4 comprises an axial radial abutment shoulder 17 sized to abut against a peripheral edge of the outer tubular body 16.

The heating device 1, thanks to its compact and annular conformation, in use, is inserted inside a hairdryer 100 comprising a handle 101 and a main body 102 extending transversely to the handle (at least in use) and defining therein an annular chamber 103 bounded between an inner tubular wall 103*a* and an outer tubular wall 103*b*.

The annular chamber 103 has at least one outlet annular mouth 104 located at one of its axial ends and comprises therein a heating device 1, as schematically illustrated in FIG. 5.

In a further embodiment, illustrated in FIGS. 6*a*-6*b*, the heating device 1 is used in the assembly of a ventilation (or blowing) device 50 for a hairdryer 100, 200.

This blowing device 50, in fact, provides that an electric motor 51 shall be housed inside the inner tubular body 2 of the heating device 1.

In particular, the electric motor 51 is provided with a stator body 52 and a rotatable rotor connected to a drive shaft 53.

The stator body 52 is housed in the inner tubular body 2. The drive shaft 53 is rotatable coaxially with the central axis "A" and extends axially up to a free end 53*a* protruding from the first section 3*a* of the inner tubular body 2.

In other words, the free end 53*a* protrudes from the axial overall size of the heating device 1.

In this regard, in fact, the blowing device 50 comprises a fan 54 fixed to said free end 53*a* of the shaft and provided with a plurality of blades 54*a* shaped so as to generate a flow of air directed toward the heating device 1.

In particular, the fan 54 faces the first section 3*a* of the inner tubular body 2 and has a radial extent such that the blades at least partly face the corrugated resistive coil 6.

Advantageously, in this way, it is possible to obtain an extremely compact and functional structure, in which the heating and ventilation/blowing operations are carried out in a limited space.

Preferably, moreover, the blowing device 50 also comprises a control circuit 55 for the electric motor 51 and/or the heating device 1.

This control circuit 55, in turn, is preferably housed inside the inner tubular body 2 of the heating device 1 and abutted against the stator body 52 of the electric motor 51, which allows the overall size of the device 50 to be further reduced.

It should be noted that, with regard to the blowing device 50 as described herein and object of the present invention, the resistive coil can be of any type or shape and, although it is preferable, it is not strictly necessary for it to include the presence of the rectilinear portions for housing the safety device 9 and the thermostat 10, which, for example, could also be positioned outside the angular sectors.

In fact, independently of the conformation of the resistive coil and the positioning of the safety device 9 and the thermostat 10, the blowing device 50 can be used inside the hairdryer 200 schematically shown by way of example in FIGS. 7*a*-7*c*.

Such a hairdryer 200 comprises a handle 201 and a main body 202 extending transversely to said handle 201.

The main body 202 defines therein a containment compartment 203 extending along its main axis between a first 203*a* and a second end portion 203*b*.

The first end portion 203*a* has a suction mouth 204. In other words, an opening is provided at the first end portion 203*a*, which is preferably occluded by a grid 205 or filter mesh.

On the other hand, the second end portion 203*b* has an air outlet 206 defining an annular blowing nozzle 207.

The blowing device 50 is housed in the containment compartment 203 and oriented so that the fan 54 faces said suction mouth 204, and said second section of the inner tubular body 2 of the heating device 1 faces said outlet 206.

Preferably, in order to define the annular shape of the blowing nozzle 207, a section reducer 208 is provided, which is coaxially inserted in said outlet 206 of the main body 202 so as to delimit an annular gap.

More precisely, the section reducer 208 comprises at least one tubular wall 208*a* inserted in the outlet 206 and partly protruding externally thereto, and at least one back wall 208*b* visible from the outside of the hairdryer 200.

The invention achieves the intended objects and attains important advantages.

In fact, the arrangement of a coil having a plurality of turns equipped with two adjacent rectilinear portions interspersed with an anchoring wave allows the efficiency of the device to be maximized, without compromising its (mechanical) robustness.

In fact, the positioning of the fuse and the thermostat in two adjacent angular sectors makes it possible to reduce the electrical connections along the inner tubular body.

By providing an anchoring wave between the two rectilinear portions, the same are prevented from increasing the fragility of the coil, which, as is known, must guarantee remarkable resistance to impacts.

Moreover, regardless of the presence of the rectilinear portions, the arrangement of a "coaxial" heating device makes it possible to combine the motor/resistance structure, making it very easy to create a compact blowing device.

Furthermore, the use of this blowing device, which is capable of generating an annular hot air flow, can be exploited in an innovative way for the production of a hairdryer designed to generate an annular blade of air even in the presence of a containment body of the traditional type.

The invention claimed is:

1. An air heating device for a hairdryer, comprising:

an inner tubular body extending along a central axis and provided with an outer surface from which a plurality of mutually angularly spaced, radial baffles extend so as to define a plurality of angular sectors;

a corrugated resistive coil extending circumferentially around said inner tubular body, resting on said radial baffles, and defining a plurality of turns arranged in succession along the central axis;

a safety device placed in electrical connection with said corrugated resistive coil;

a thermostat placed in electrical connection with said corrugated resistive coil;

an outer tubular body made of insulating material and arranged coaxially with said inner tubular body around said corrugated resistive coil;

characterised in that said safety device and said thermostat are respectively housed in a first and a second angular sector, which are adjacent to each other and separated by a shared radial baffle, wherein the corrugated resistive coil comprises a plurality of first turns provided with:

two rectilinear portions positioned at the first and the second angular sector, respectively;

at least one anchoring wave interposed between said rectilinear portions and overlying said shared radial baffle.

2. The heating device according to claim 1, wherein said corrugated resistive coil defines a succession of peaks and grooves oriented circumferentially around said inner tubular body; said at least one anchoring wave comprising two grooves between which a peak straddling said shared radial baffle is interposed.

3. The heating device according to claim 1, wherein each radial baffle has a toothed, radially outer edge, so as to define a succession of seats for housing the turns of the resistive coil; said anchoring wave overlying the shared baffle at a housing seat.

4. The heating device according to claim 1, wherein said safety device and said thermostat have a respective axial overall size along said central axis; said plurality of first turns extending at least at said axial overall size.

5. The heating device according to claim 4, wherein said corrugated resistive coil further comprises one or more second turns located outside of said axial overall size and devoid of said rectilinear portions.

6. The heating device according to claim 1, wherein said inner tubular body is in one piece and comprises a plurality of retaining portions for retaining the mutually angularly spaced, radial baffles.

7. The heating device according to claim 6, wherein the inner tubular body is made by moulding plastic material, and said outer tubular body is made of mica.

8. The heating device according to claim 1, comprising a thermistor arranged outside the inner tubular body at a third angular sector and oriented transversely to said central axis.

9. The heating device according to claim 8, wherein the inner tubular body extends along said central axis between a first section, in use an air flow inlet, and a second section, in use an air flow outlet; said thermistor being located in the vicinity of said second section in order to receive a flow of air heated by the corrugated resistive coil.

10. The heating device according to claim 9, comprising a plurality of electrical connections arranged at said first section of the inner tubular body, and at least a pair of conductive tracks anchored to the inner tubular body and extending from said electrical connections up to said thermistor.

11. A blowing device for a hairdryer, comprising:

a heating device according to claim 1;

an electric motor provided with a stator body housed inside the inner tubular body of the heating device and equipped with a drive shaft rotatable coaxially with said central axis; said drive shaft extending axially up to a free end protruding from said first section of the inner tubular body;

a fan fixed to said free end and provided with a plurality of blades shaped so as to generate a flow of air directed toward the heating device.

12. The blowing device according to claim 11, comprising a control circuit controlling said electric motor and said heating device, which is housed inside said inner tubular body of the heating device and abutted against the stator body of the electric motor.

13. A hairdryer, comprising:

a handle;

a main body extending transversely to said handle and defining therein an annular chamber bounded between an inner tubular wall and an outer tubular wall; said annular chamber having at least one outlet annular mouth located at one of its axial ends;

a heating device according to claim 1 placed inside said annular chamber.

* * * * *